US010788166B2

(12) United States Patent
Hong et al.

(10) Patent No.: US 10,788,166 B2
(45) Date of Patent: Sep. 29, 2020

(54) TYPE OF LED LAMP STRUCTURE AND ITS PREPARATION PROCESS

(71) Applicant: GMY Lighting Technology Co., Ltd., Heshan (CN)

(72) Inventors: Yannan Hong, Heshan (CN); Lisheng Li, Heshan (CN); Liangping Tan, Heshan (CN); Liu Liu, Heshan (CN); Hanyao Li, Heshan (CN)

(73) Assignee: GMY Lighting Technology Co., Ltd. (CN)

( * ) Notice: Subject to any disclaimer, the term of this patent is extended or adjusted under 35 U.S.C. 154(b) by 117 days.

(21) Appl. No.: 16/076,250

(22) PCT Filed: Aug. 29, 2017

(86) PCT No.: PCT/CN2017/099461
§ 371 (c)(1),
(2) Date: Aug. 7, 2018

(87) PCT Pub. No.: WO2018/201643
PCT Pub. Date: Nov. 8, 2018

(65) Prior Publication Data

US 2020/0132257 A1 Apr. 30, 2020

(30) Foreign Application Priority Data

May 5, 2017 (CN) ..... 2017 1 0312546
May 5, 2017 (CN) ..... 2017 2 0493518 U
(Continued)

(51) Int. Cl.
*F21K 9/238* (2016.01)
*F21V 29/70* (2015.01)
(Continued)

(52) U.S. Cl.
CPC ..... *F21K 9/238* (2016.08); *F21K 9/232* (2016.08); *F21K 9/90* (2013.01); *F21V 23/002* (2013.01);
(Continued)

(58) Field of Classification Search
CPC . F21K 9/238; F21K 9/90; F21K 9/232; F21V 23/002; F21V 23/006; F21V 29/70; F21V 23/06; F21V 23/00; F21Y 2115/10
See application file for complete search history.

(56) References Cited

U.S. PATENT DOCUMENTS

2006/0126328 A1* 6/2006 Coushaine ..... F21V 29/74 362/247
2012/0212137 A1* 8/2012 Chiang ..... F21K 9/90 315/112
(Continued)

FOREIGN PATENT DOCUMENTS

CN 204372620 U 6/2015
CN 204437741 U 7/2015
(Continued)

OTHER PUBLICATIONS

Machine English Translation of CN205244869U (Year: 2016).*
(Continued)

*Primary Examiner* — Isiaka O Akanbi
*Assistant Examiner* — Glenn D Zimmerman
(74) *Attorney, Agent, or Firm* — Lerner, David, Littenberg, Krumholz & Mentlik, LLP

(57) ABSTRACT

A type of LED lamp structure and its preparation process are disclosed, where insulation casings are placed over two thin wires extended from the bulb shell to prevent the two electrodes from contacting before they are electrically connected with the driver power supply, usually by welding or winding. The LED lamp structure of the embodiments of the
(Continued)

present invention includes: light-emitting components, driver power supply and electrical connection components; the light-emitting components include an LED lamp pole. Thick wires are installed below the LED lamp pole and the thick wires are electrically connected to the LED lamp pole; the driver power supply includes the driver circuit board and the driver circuit board is connected to the female connector for plugging to the thick wires, so that the thick wires are electrically connected to the driver power supply through the female connector.

14 Claims, 10 Drawing Sheets

(30) Foreign Application Priority Data

May 9, 2017 (CN) ..... 2017 1 0322054
May 9, 2017 (CN) ..... 2017 2 0507693 U

(51) Int. Cl.

| | |
|---|---|
| ***F21K 9/232*** | (2016.01) |
| ***F21K 9/90*** | (2016.01) |
| ***F21V 23/00*** | (2015.01) |
| ***F21V 23/06*** | (2006.01) |
| *F21Y 115/10* | (2016.01) |

(52) U.S. Cl.
CPC ..... *F21V 23/006* (2013.01); *F21V 23/06* (2013.01); *F21V 29/70* (2015.01); *F21Y 2115/10* (2016.08)

(56) References Cited

U.S. PATENT DOCUMENTS

| | | | | |
|---|---|---|---|---|
| 2013/0257278 | A1* | 10/2013 | DeVore | H01J 5/54 315/113 |
| 2017/0019973 | A1 | 1/2017 | Beck et al. | |
| 2017/0254483 | A1* | 9/2017 | Klafta | F21K 9/238 |
| 2018/0128447 | A1* | 5/2018 | Chen | F21V 17/12 |

FOREIGN PATENT DOCUMENTS

| | | | | | |
|---|---|---|---|---|---|
| CN | 105135383 | A | | 12/2015 | |
| CN | 105465657 | A | * | 4/2016 | F21K 9/23 |
| CN | 205244869 | U | * | 5/2016 | |
| CN | 106382514 | A | | 2/2017 | |
| CN | 205979242 | U | | 2/2017 | |
| CN | 106958751 | A | | 7/2017 | |

OTHER PUBLICATIONS

Machine English Translation of CN105465657A (Year: 2016).*
International Search Report for PCT/CN2017/099461, dated Jan. 23, 2018.

* cited by examiner

TYPE OF LED LAMP STRUCTURE AND ITS PREPARATION PROCESS

CROSS-REFERENCE TO RELATED APPLICATIONS

The present application is a national phase entry under 35 U.S.C § 371 of International Application No. PCT/CN2017/099461 filed Aug. 29, 2017, which claims priority from Chinese Application Nos. 201710312546.4 filed May 5, 2017, 201720493518.2, filed May 5, 2017, 201710322054.3, filed May 9, 2017, 201720507693.2, filed May 9, 2017 all of which are hereby incorporated herein by reference.

TECHNICAL FIELD

The present invention involves the field of LED lamp technology, especially involving a type of LED lamp structure and its preparation process.

BACKGROUND ART

In the past, to achieve a certain light intensity and area of illumination, LED light sources needed to be installed with lenses or other optical devices, affecting the illumination effect and lowering the energy-saving effect that LED [lamps] should have. However, the LED filament light bulb achieves 360° full-angle illumination, emitting light at large angles without requiring lenses, achieving a three-dimensional light source. The emergence of the tungsten-filament incandescent light in the 19th century led the world into the era of man-made lighting. Since the emergence of the new revolutionary light source—LED—in the 20th century, by virtue of its advantages such as being energy-saving and environmentally friendly and having a long useful life, it quickly became popular in the lighting market. LED has become the mainstream light source in lighting of the future and is widely applied in commercial lighting, industrial lighting, outdoor lighting, etc. However, its development is relatively slow in the area of general consumer lighting. For many people, LED lamps are a new light source that they have never heard of. In 2008, Ushio Lighting of Japan launched the "LED filament light bulb", an incandescent light prototype light bulb equipped with LED, and reversed this phenomenon. With "traditional appearance and upgraded 'formula'", people understood that it was a familiar lighting lamp when they saw the LED lamp that it featured. Thereafter, a large number of candle lamps, chandeliers and light bulbs with LED filament light sources started to appear and became increasingly accepted by consumers.

Before the driver is installed in existing LED light bulbs with glass stems, insulation casings are placed over the thin wires extending out from the glass stem that are electrically connected to the LED light source in the glass bulb shell to prevent the thin wires from contacting and causing a short circuit, before the thin wires are electrically connected to the driver power supply. The thin wires are generally welded or wound around the driver power supply, thereby resulting in the technical problems from the complicated process and high labor and material costs.

Content of the Invention

The embodiments of the present invention provide a type of LED lamp structure and its preparation process, resolving the technical problems of complicated processes, and the high labor and material costs caused by placing insulation casings over the thin wires extending from the glass stem and electrically connected to the filament in the glass bulb shell to prevent short circuits from contact between two electrodes before electrical connection to the driver power supply of the existing LED light bulb through welding or winding.

The embodiments of the present invention provide a type of LED lamp structure, including:

Light-emitting components, driver power supply and electrical connection components;

Said light-emitting components include an LED lamp pole. Thick wires are installed below said LED lamp pole and said thick wires are electrically connected to said LED lamp pole;

The driver power supply includes a driver circuit board and said driver circuit board is connected to a female connector for plugging to said thick wires, so that said thick wires are electrically connected to said driver power supply through said female connector.

Optionally, the LED lamp structure also includes an insulation sleeve and said driver power supply is installed inside the hollow structure of said insulation sleeve.

Optionally, said driver circuit board is welded to an edge wire. Said edge wire is of a bendable structure. When said driver power supply is installed inside the hollow structure of said insulation sleeve, said edge wire bends and extends out of the outer wall of said insulation sleeve.

Optionally, said female connector is of a hollow structure and at least one end is an end with a funnel-shaped opening.

Optionally, a contact pin is installed between said female connector and said driver circuit board. Said funnel-shaped opening end of said female connector is joined to one end of said contact pin and the other end of said contact pin is welded to said driver circuit board.

Optionally, said funnel-shaped opening end of said female connector is connected to said thick wires.

Optionally, both ends of said female connector have a funnel-shaped opening structure and they are respectively joined to the non-welded end of said contact pin and said driver circuit board, as well as the non-connected end of said thick wires and said LED lamp pole.

Optionally, said driver circuit board is horizontally or vertically installed inside the hollow structure of said insulation sleeve.

Optionally, said LED lamp pole includes a stem and an LED light source. The inside of said stem is of a hollow structure, causing said thick wires to pass through said hollow structure to be electrically connected to said LED light source.

Optionally, there are two of said thick wires and said female connectors, and they are respectively two poles for electrical connection.

Optionally, the inner cross-section of said stem is "凵" shaped and the concave part of the "凵" is said hollow structure. The peak of the "凵" is the exhaust pipe, which is used in filling inert gases for heat dissipation into the bulb shell of the LED lamp structure.

Optionally, the LED lamp structure also includes a lamp holder. Said insulation sleeve is fastened to the inside of said lamp holder by injecting mud and a rivet is installed at the bottom on the outside of said lamp holder.

Optionally, said driver circuit board horizontally installed inside the hollow structure of the insulation sleeve is round, or said driver circuit board vertically installed inside the hollow structure of the insulation sleeve is rectangular.

Optionally, the range of the diameter of said thick wires is 0.3-1.8 mm.

Optionally, the diameter of said edge wire is greater than 0.3 mm.

Optionally, a cut-off point is installed in the middle of said female connector and one end of said female connector extends into the bell mouth of said stem.

Optionally, said funnel-shaped opening end of said female connector does not extend beyond the bell mouth of said stem.

Optionally, the length of said thick wires extending from the bell mouth of said stem does not exceed 5 mm.

The embodiments of the present invention provide another type of LED lamp structure, including:

Light-emitting components, driver power supply and electrical connection components; The LED lamp pole of said light-emitting components includes a stem and LED light source. Top thick wires are installed on top of said stem and bottom thick wires are installed below said stem. At least one of said top thick wires is electrically connected to said LED light source through a female connector;

The driver power supply includes a driver circuit board. The contact pin of said driver circuit board is electrically connected to said bottom thick wires.

Optionally, said top thick wires are further fastened to said female connector through pressing, bending or welding.

The embodiments of the present invention provide the preparation process of a type of LED lamp structure, including:

Step 1: Weld the stem with the thick wires to the light source;

Step 2: Fuse and seal the bell mouth of the stem and the opening end of the bulb shell;

Step 3: Fill the bulb shell with heat-dissipating inert gases from the exhaust pipe and seal the exhaust pipe;

Step 4: Place the insulation sleeve outside of the driver power supply, wind the edge wire around the insulation sleeve and extend it upwards out of the insulation sleeve;

Step 5: Install the driver power supply in the lamp holder, extend an electrode wire on the driver circuit board out from the hole of the lamp holder and the edge wire is pressed between the insulation sleeve and lamp holder;

Step 6: Welding of mud into the lamp holder and fasten the driver power supply in the lamp holder;

Step 7: Assemble the lamp holder, plug the thick wires to the female connector, extend one end of the female connector into the bell mouth of the stem and the thick wires shall not extend beyond the bell mouth of the stem or the length extending beyond the bell mouth of the stem shall not exceed 5 mm. Weld the other end of the female connector onto the driver circuit hoard. At the same time, install the lamp holder onto the sealing position of the bulb shell and fasten and connect by welding with mud;

Step 8: Fasten the rivet onto the hole of the lamp holder and at the same time, electrically connect to said electrode wire of the driver circuit board.

Optionally, step 7 specifically includes:

Where the female connector is a double-head female connector, a cut-off point is installed in the middle. When two contact pins are installed on the driver power supply and while assembling the lamp holder, plug one end of the female connector to the thick wires, then plug the contact pin to the other end of the female connector. The female connector may also be plugged to the contact pin first before the thick wires are plugged to the other end of the female connector. The thick wires and contact pin do not extend beyond the middle cut-off point of the female connector and said thick wires do not extend beyond the position of the bell mouth of the stem. At the same time, one end of the female connector extends into the bell mouth of the stem and the other end out of the bell mouth of the stem.

The embodiments of the present invention also provide a type of preparation process of LED lamp structure, characterized in that it includes:

Step 1: Weld the light source onto the stem with the thick wires and that is welded with the female connector on the thick wires. Said female connector is entirely positioned inside of the bell mouth of the stem;

Step 2: Fuse and seal the bell mouth of the stem and the opening end of the bulb shell;

Step 3: Fill the bulb shell with heat-dissipating inert gases from the exhaust pipe and seal the exhaust pipe;

Step 4: Place the insulation sleeve outside of the driver power supply, wind the edge wire around the insulation sleeve and extend it upwards out of the insulation sleeve;

Step 5: Install the driver power supply in the lamp holder, extend one electrode wire of the driver power supply outside of the hole of the lamp holder and the edge wire is pressed between the insulation sleeve and lamp holder;

Step 6: Welding of mud into the lamp holder and fasten the driver power supply in the lamp holder;

Step 7: Assemble the lamp holder, position both ends of the female connector into the bell mouth of the stem, plug the contact pin on the driver power supply to the female connector and the thick wires shall not extend out of the bell mouth of the stem. At the same time, install the lamp holder onto the sealing position of the bulb shell and fasten and connect them by welding with mud;

Step 8: Fasten the rivet onto the hole of the lamp holder. At the same time, electrically connect it with said electrode wire of the driver power supply.

It may be seen from the technical scheme above that the embodiments of the present invention have the following advantages:

The embodiments of the present invention provide a type of LED lamp structure and its preparation process. The LED lamp structure includes: light-emitting components, driver power supply and electrical connection components; the light-emitting components include an LED lamp pole. Thick wires are installed below the LED lamp pole and the thick wires are electrically connected to the LED lamp pole; the driver power supply includes a driver circuit board. Said driver circuit board is connected to a female connector that is plugged to the thick wires, causing the thick wires to be electrically connected to the welded devices on the driver circuit board through the female connector. In this embodiment, the thick wires are electrically connected to the driver power supply through the female connector, making redundant the process of placing the insulation sleeve on the thin wires; thereby conserving materials and also simplifying the process. The female connector is installed between the driver and bulb shell and as compared to the female connector being installed between the lamp holder and the driver, during installation, the plugging of the thick wires and female connector is visible, guaranteeing the quality of the product. At the same time, the thick wires do not extend beyond the position of the bell mouth, so it will not affect the sealing and forming of the bulb shell opening and bell mouth of the stem, nor will it affect the sealing of the gas drainage pipe or oxidize and burn the thick wires under high-temperature burning, thereby causing poor conduction during plugging. In addition, the weld-free design of the edge wire has a simple structure and may be operated easily, greatly simplifying the process.

DESCRIPTIONS OF DRAWINGS

To describe the technical schemes of the embodiments of the present invention or in existing art in a clearer manner, the following drawings, which are needed for the description of the embodiments or existing art, will be described briefly. Obviously, the drawings in the following description are only some embodiments of the present invention, and those of ordinary skill in the art may still acquire other drawings based on the following drawings without creative effort.

Figure 3A:
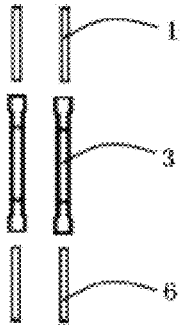
Figure 3B:
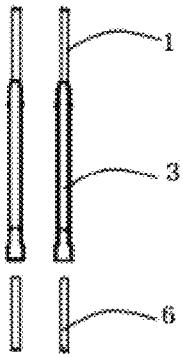
Figure 3C:
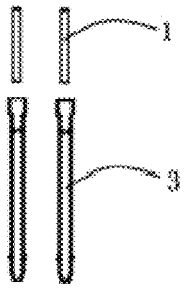
Figure 4A:
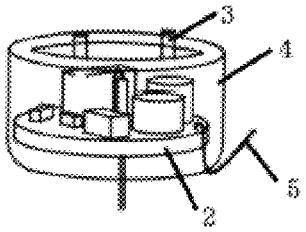
Figure 4B:
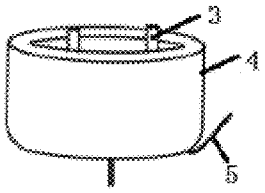
Figure 5:
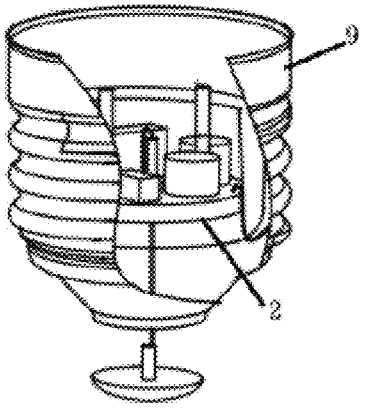
Figure 6:
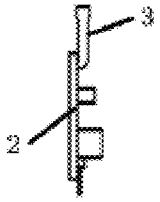
Figure 7A:
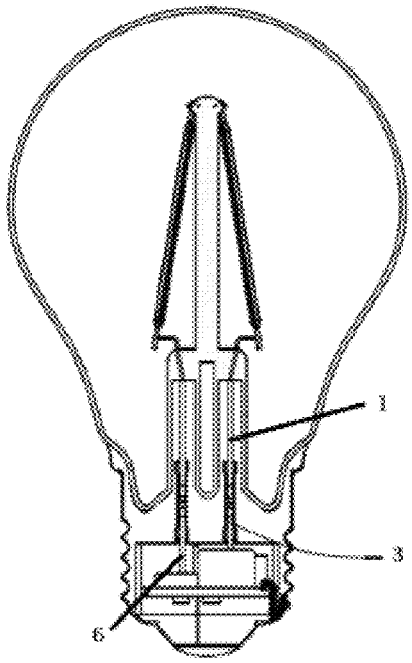
Figure 7B:
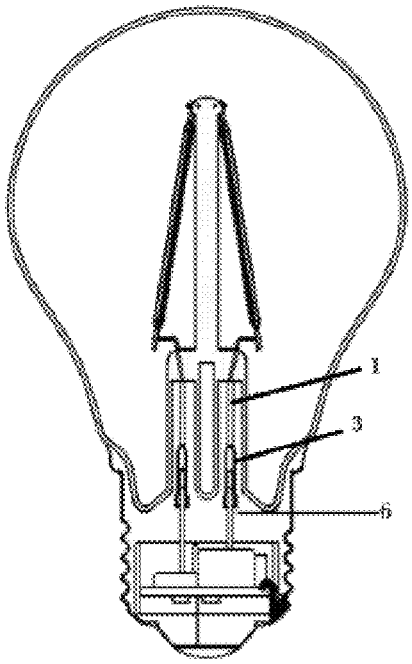
Figure 7C:
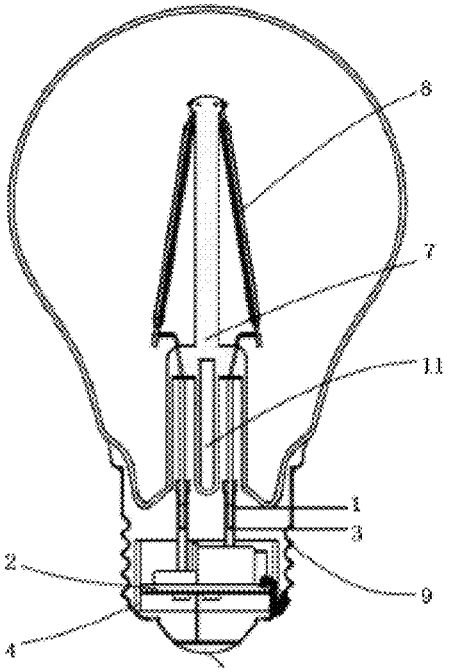
Figure 8:
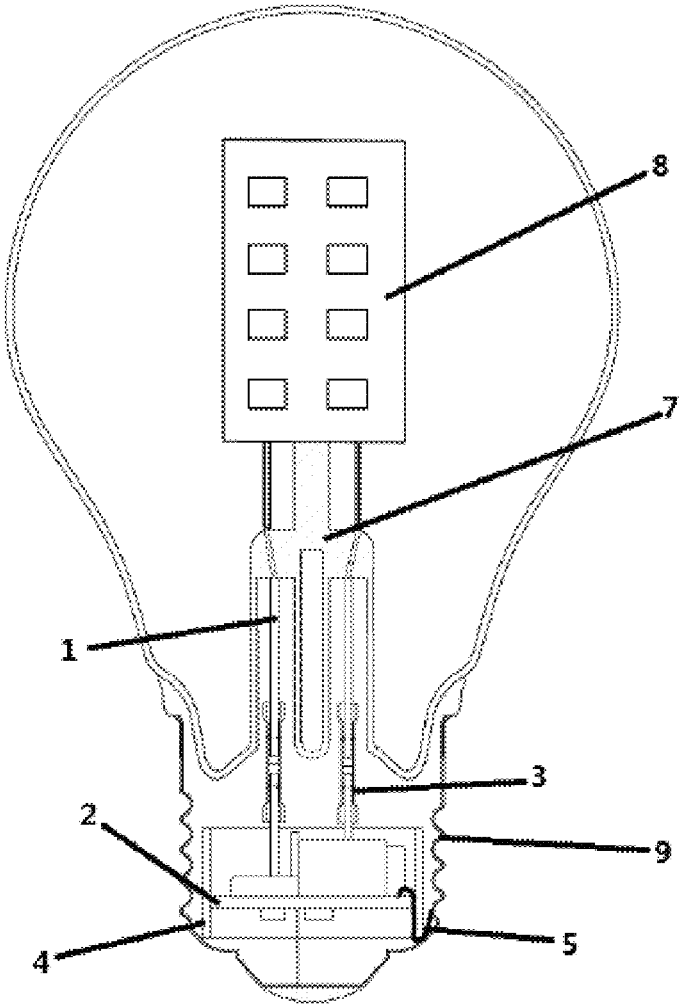
Figure 9:
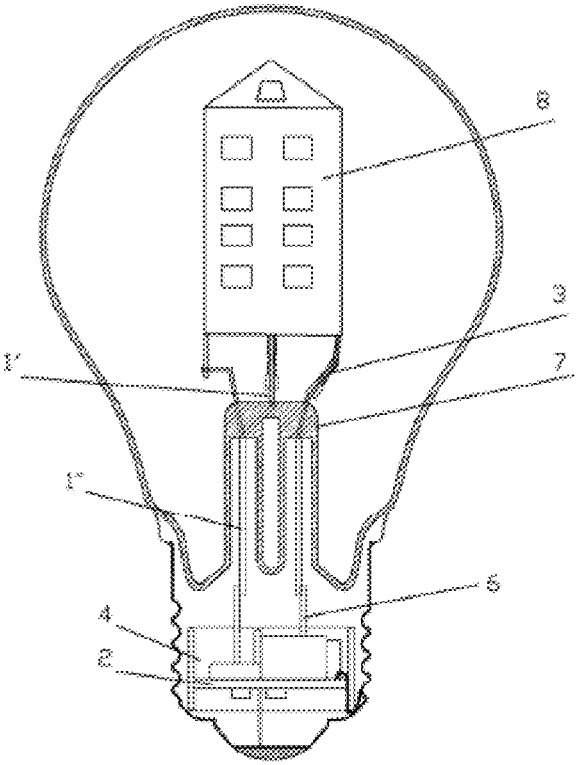

FIGS. 3 (*a*) to (*c*) are schematic diagrams of the female connectors and thick wires;

FIGS. 4 (*a*) and (*b*) are diagrams of the driver circuit board installed inside the insulation sleeve;

FIG. 5 is the sectional view of the driver circuit board and insulation sleeve installed in the lamp holder;

FIG. 6 is the diagram of the driver circuit board and female connector of the second embodiment;

FIGS. 7 (*a*) to (*c*) are the schematic diagrams of the female connectors and thick wires based on FIGS. 3 (*a*) to (*c*);

FIG. 8 is the diagram of the LED light source being a surface-mounted LED light source based on the first embodiment;

FIG. 9 is the schematic diagram of the fourth embodiment of a type of LED lamp structure provided by the embodiments of the present invention.

Description of illustrations: thick wires 1, driver circuit board 2, female connector 3, insulation sleeve 4, edge wire 5, contact pin 6, stem 7, LED light source 8, lamp holder 9, rivet 10, exhaust pipe 11, top thick wires 1', bottom thick wires 1"

SPECIFIC EMBODIMENT METHODS

The embodiments of the present invention provide a type of LED lamp structure and its preparation process, resolving the technical problems of complicated processes, and the high labor and material costs caused by placing insulation casings over the two thin wires extending from the bulb shell to prevent the two electrodes from contacting, before electrical connection to the driver power supply through welding or winding when installing the driver of the existing filament light bulb.

In order to further clarify and simplify the purpose of invention, features and advantages of the present invention, clear and complete descriptions on the technical schemes in the embodiments of the present invention are provided below with the drawings in the embodiments of the present invention. Obviously, the embodiments described below are only some embodiments of the present invention and not all embodiments. Based on the embodiments in the present invention, all other embodiments acquired by those of ordinary skill in the art without creative labor belong within the scope protected by the present invention.

Figure 1:
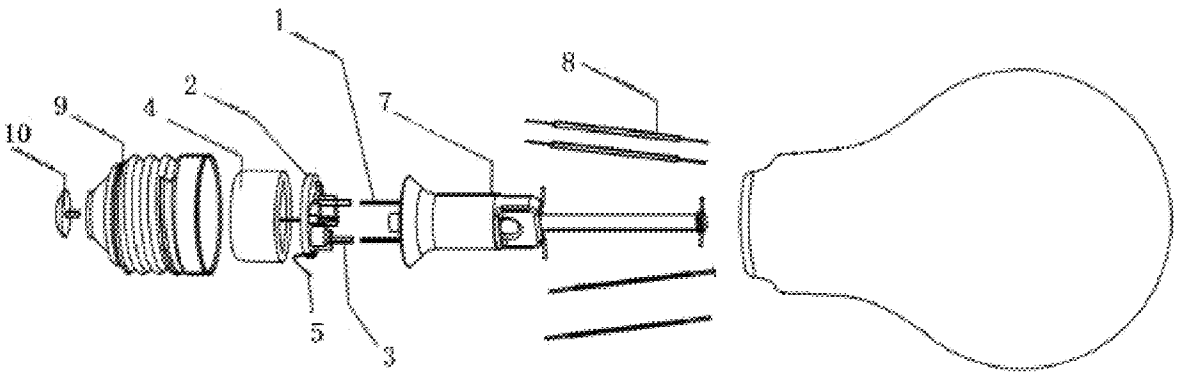
FIG. 1 is the schematic diagram of the first embodiment of a type of LED lamp structure provided by the embodiments of the present invention.

Please refer to FIG. 1 and FIG. 6. An embodiment of a type of LED lamp structure provided in the embodiments of the present invention includes:

Light-emitting components, driver power supply and electrical connection components;

The light-emitting components include an LED lamp pole. Thick wires 1 are installed below the LED lamp pole and the thick wires 1 are electrically connected to the LED lamp pole;

The driver power supply includes a driver circuit board 2. Said driver circuit board 2 is connected to a female connector 3 plugged to the thick wires 1, causing the thick wires 1 to be electrically connected to the driver power supply through the female connector 3. Said female connector is positioned between the driver circuit board and the LED lamp pole.

It must be stated that the two thin wires are changed to two thick wires 1, so the insulation casing no longer needs to be placed over them. The range of the diameter of thick wires 1 is 0.3-1.8 mm.

The following is described respectively using embodiments. The first embodiment includes:

As shown in FIG. 1, the driver circuit board 2 is horizontally (as shown in FIG. 1) installed inside the hollow structure of the insulation sleeve 4. The female connector 3 is vertically installed on the surface of the driver circuit board 2 and the female connector 3 forms a straight line with the thick wires 1.

Figure 2:
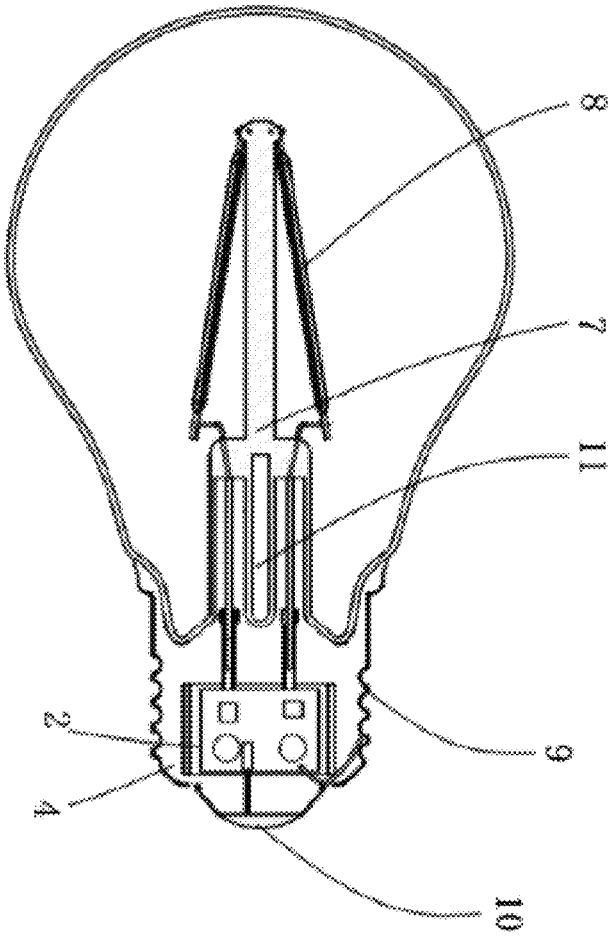
FIG. 2 is the schematic diagram of the second embodiment of a type of LED lamp structure provided by the embodiments of the present invention.

The driver circuit board 2 shown in FIG. 2 is vertically (as shown in FIG. 2) installed inside the hollow structure of the insulation sleeve 4. As shown in FIG. 6, similar to the first embodiment, the female connector 3 forms a straight line with the thick wires 1. However, the driver circuit board 2 is connected to female connector 3 through the bent structure at the connecting part of the vertical driver circuit board 2.

The LED lamp structure also includes an insulation sleeve 4. The driver power supply is installed inside the hollow structure of the insulation sleeve 4.

The difference between the first embodiment and the second embodiment is that the driver circuit board 2 horizontally installed inside the hollow structure of the insulation sleeve 4 is round, or the driver circuit board 2 vertically installed inside the hollow structure of the insulation sleeve 4 is rectangular. Compatible improvements may be made on the shape and the horizontal or vertical installation of the driver circuit board 2, based on the internal structure of the lamp holder 9.

Based on the first embodiment and second embodiment and as shown in FIGS. 4 (*a*) and (*b*), the driver circuit board 2 is welded to an edge wire 5. The edge wire 5 is of a bendable structure. When the driver power supply is installed inside the hollow structure of the insulation sleeve 4, after the edge wire 5 is extended downwards, it is bent and extended upwards out of the outer wall of the insulation sleeve 4. It must be explained that the diameter of the edge wire 5 is greater than 0.3 mm. One end of it is electrically connected to the driver power supply and one end is extended towards the side, and it is in direct contact with the lamp holder 9, so it does not need to be welded to the lamp holder. Furthermore, the gap between the insulation sleeve 4 and the internal wall of the lamp holder 9 is approximately 0-5 mm. The edge wire 5 with the aforementioned bendable structure is in electrical contact with the lamp holder 9 through a V or Z bend. Even if the gap cannot be completely filled, it may be in electrical contact with the lamp holder 9 as the wire is flexible.

Based on the first embodiment and the second embodiment, the female connector 3 is of a hollow structure and at least one end has a funnel-shaped opening.

The multiple connection methods of the female connector 3 are described below: As shown in FIG. 3 (*a*) and FIG. 7 (*a*), a contact pin 6 is installed between the female connector 3 and the driver circuit board 2. Both ends of the female connector 3 have a funnel-shaped opening structure and they are respectively joined to the non-welded end of the contact pin 6 and the driver circuit board 2, as well as the non-connected end of the thick wires 1 and the LED lamp pole. It must be stated that inside the female connector, there is a middle cut-off point and the contact pin 6 and thick wires 1 will not extend beyond the aforementioned middle cut-off point, ensuring that both ends of the female connector have sufficient length to be joined to the contact pin or thick wires respectively. Moreover, one end of the female connector 3 joined to the thick wires is extended into the bell mouth structure of the stem.

As shown in FIG. 3 (*b*) and FIG. 7 (*b*), the contact pin 6 is installed between the female connector 3 and the driver circuit board 2. The end of female connector 3 with the funnel-shaped opening is joined to one end of the contact pin 6 and the other end of the contact pin 6 is welded to the driver circuit board 2. The other end of the female connector 3 is welded to the thick wires and the female connector 3 is entirely positioned in the cavity structure of the stem, not extending beyond the position of the bell mouth structure in the stem.

As shown in FIG. 3 (*c*) and FIG. 7 (*c*), where the female connector 3 is a single-head female connector 3, one end of the female connector 3 is directly fastened to the driver power supply to be electrically connected with the driver power supply. The other end extends towards the bulb shell into the bell mouth structure of the stem and is electrically connected with the two thick wires 1. The end of said female connector 3 connected to the thick wires 1 is the end with the funnel-shaped opening.

It may be understood that the female connector 3 or the contact pin 6 and the electric components are welded onto driver circuit board 2. The round driver circuit board 2 is installed on the front and the female connector 3 is installed between the driver circuit board and the bulb shell. The range of the length of the female connector 3 is 5 to 25 mm and the thick wires 1 are electrically connected to the driver power supply by being plugged to the female connector 3, and so welding or winding of the wire is not required. There will not be blank welding or pseudo welding here; the operations are convenient and product defect-free ratio is high. This effectively resolves the quality problems arising from damage to electric components due to improper electric iron operations or improper winding force.

As shown in FIG. 1, FIG. 2 and FIG. 8, the LED lamp pole includes a stem 7 and an LED light source 8. Said LED light source 8 is an LED filament or a surface-mounted LED light source (as shown in FIG. 8), etc. The inside of the stem 7 is of a hollow structure and the thick wires are placed in said hollow structure and electrically connected to the tungsten-molybdenum wire sealed onto the stem. The other end of the tungsten-molybdenum wire is electrically connected to the LED light source 8.

Based on the first embodiment and the second embodiment, there are two thick wires 1 and female connectors 3, and they are the positive and negative poles for electrical connection.

Optionally, as shown in FIGS. 7 (*a*) to (*c*), the inner cross-section of the stem 7 is "凵" shaped and the concave part of the "凵" is of a hollow structure. The opening of the hollow structure is the bell mouth structure and peak of the "凵" is the exhaust pipe 11, which is used in filling insert gases for heat dissipation into the bulb shell of the LED lamp structure. The two thick wires 1 are at both sides of the exhaust pipe, respectively. Furthermore, said exhaust pipe 11 does not extend beyond the position of the bell mouth.

Optionally, as shown in FIG. 5, the LED lamp structure also includes the lamp holder 9. The insulation sleeve 4 is fastened to the inside of the lamp holder 9 by injecting mud. The rivet 10 is installed to the bottom of the lamp holder 9 on the outside.

The preparation process of the LED lamp structure is described below:

When embodiment 1 uses the single-head female connector 3: 1. Weld the light source. Weld the stem with the thick wires 1 onto the light source; 2. Then seal and mold the bell mouth of the stem and the opening end of the bulb shell through fire fusing. Generally, the fire temperature is 500 to 700° C.; 3. Discharge gas. fill the bulb shell with heat-dissipating inert gases from the exhaust pipe 11, then seal the exhaust pipe 11 with fire; 4. Place the insulation sleeve 4 outside of the driver, wind the edge wire 5 over the insulation sleeve 4 and extend it upwards outside of the insulation sleeve 4; 5. Assemble the driver and place the driver power supply inside the lamp holder 9. At this time the electrode wire of one resistance on the driver extends out of the hole of the lamp holder. The edge wire 5 is pressed between the insulation sleeve 4 and the lamp holder 9. The driver power supply installed in the lamp holder 9 will be loose. To ensure that the edge wire 5 is in good contact and may be electrically connected with the lamp holder 9, the diameter of edge wire 5 is sufficiently large, at least more than 0.3 mm. This way, the edge wire 5 does not need to be welded with the lamp holder 9, making redundant the edge wire welding process; 6. Inject mud. Welding of mud into the lamp holder 9 and fasten the driver inside the lamp holder 9; 7. Assemble the lamp holder 9. Plug the thick wires 1 to the female connector 3, extend one end of the female connector into the bell mouth of the stem and thick wires 1 shall not extend out of the bell mouth of the stem or they extend less than 5 mm from the bell mouth of the stem, so the sealing and molding of the bell mouth and the bulb shell and the sealing of the exhaust pipe are not affected because the length of the thick wires extending from the bell mouth is too long. The thick wires will also not oxidize or be burnt from being in the fire at a high temperature, thereby causing poor conduction during plugging. At this time, weld the other end of the female connector 3 onto the driver circuit board and at the same time, install the lamp holder 9 at the sealing position of the bulb shell and fasten and connect by welding with mud; 8. Lastly, fasten the rivet 10 on the hole of the lamp holder 9 and electrically connect with the resistance electrode wire.

Furthermore, in the fusing and sealing process of the bell mouth of the stem and the opening end of the bulb shell, blow high-pressure air at the bulb shell to lower the temperature inside the bulb shell and prevent the light source from being damaged due to an excessively high temperature inside the bulb shell.

Furthermore, a metal baffle board allowing only the exhaust pipe to pass through is set up in the sealing process of the exhaust pipe 11. When the fire seals the exhaust pipe below the baffle board, it may go as near to the baffle board as possible without burning the light bulb, protecting the light bulb while ensuring that the sealed exhaust pipe is as short as possible, thereby preventing the installation of the driver power supply from being affected due to the exhaust pipe being overly long.

Embodiment 2 differs from embodiment 1 in that the two thick wires 1 of the stem are welded to the single-head female connector 3. The female connector 3 is placed in the cavity of the stem and does not extend beyond the position of the bell mouth of the stem, so the female connector will not extend out of the bell mouth, affecting the sealing of the bell mouth and bulb shell and causing the gas discharge problem by the exhaust pipe. When the two contact pins 6 are installed on the driver power supply and lamp holder 9 is assembled, the two contact pins 6 on the driver power supply are plugged onto the female connector 3 of the stem.

Embodiment 3 differs from Embodiment 1 in that the female connector 3 is the double-head female connector 3. There is a cut-off point in the middle of the female connector 3. When the two contact pins 6 are installed on the driver power supply and lamp holder 9 is assembled, first plug one end of the female connector 3 to the thick wires 1, then plug the contact pin 6 to the other end of the female connector 3. The female connector 3 may also be plugged to the contact pin 6 before plugging to the thick wires 1 onto the other end of the female connector 3. The thick wires 1 and contact pin 6 will not extend beyond the cut-off point of the female connector 3 and the thick wires 1 will not extend beyond the position of the bell mouth of the stem, so the length of the said thick wires 1 extending from the bell mouth of the stem will not be overly long, affecting the sealing of the bell mouth and bulb shell and causing the gas discharge problem of the exhaust pipe. One end of the female connector 3 is then extended into the bell mouth of the stem, and the other end is outside of the bell mouth of the stem.

Embodiment 4, as shown in FIG. 9, has the top thick wires 1' installed onto the top of the stem and the bottom thick wires 1" installed below the stem. The contact pin 6 of the driver circuit board is directly welded to the bottom thick wires 1". It is easily known that said contact pin 6 may also be other metal materials, such as copper sheets or sheet iron, etc.

With regard to the LED lamp of the surface-mounted LED light source, said LED light source 8 may be fastened onto the stem through welding or plugging. Said LED light source 8 may be a polyhedral structure. Refer to FIG. 9. In this preferred embodiment, three top thick wires 1' are installed on the stem. Of which, the left top thick wires are electrically connected to the LED light source via the electric wire fastened on the LED light source and through welding. The right top thick wires are electrically connected to the LED light source by plugging to the female connector. The top thick wires in the middle are fastened and connected to the LED light source by plugging to the female connector. It is easily known that the plugging or welding method of the female connector may be of any combination.

Preferably, when plugging the female connector 3, in order to better connect the top thick wires 1' and the female connector 3, the female connector 3 and the top thick wires 1' may be further fastened through spot welding, pressing or even bending. In the pressing method, one or more spots may be extruded on female connector 3, so that the female connector 3 is clamped tightly to the top thick wires 1'.

The embodiments of the present invention provide a type of LED lamp structure, including: light-emitting components, driver power supply and electrical connection components; the light-emitting components include an LED lamp pole. Thick wires 1 are installed below the LED lamp pole and the thick wires 1 are electrically connected to the LED lamp pole; the driver power supply includes a driver circuit board 2 and the driver circuit board 2 is connected to a female connector 3 for plugging to the thick wires 1, so that the thick wires 1 are electrically connected to the welded devices on the driver circuit board 2 through the female connector 3. In this embodiment, electrical connection of the thick wires 1 to the welded devices on the driver circuit board 2 through the female connector 3 makes redundant the process of placing the insulation sleeve on the thin wires 5, thereby conserving materials and also simplifying the process. The female connector 3 is installed between the driver and bulb shell, and as compared to the female connector 3 being installed between the lamp holder 9 and the driver, during installation, the plugging of the thick wires 1 and female connector 3 is visible, guaranteeing the quality of the product. At the same time, the thick wires do not extend beyond the position of the bell mouth, so it will not affect the sealing and forming of the bulb shell and bell mouth of the stem, nor will it affect the sealing of the gas drainage pipe or oxidize and burn the thick wires under high-temperature burning, thereby causing poor conduction during plugging. In addition, the weld-free design of the edge wire 5 has a simple structure and may be operated easily, greatly simplifying the process.

In conclusion, the above embodiments are only used to explain the technical schemes of the present invention and not to restrict it; although detailed descriptions of the present invention have been given by making reference to the aforementioned embodiments, those of ordinary skill in the art should understand that: they may still amend the technical schemes stated in the various aforementioned embodiments or make equivalent replacements to some of the technical features in the scheme; these amendments or replacements do not cause the essence of the corresponding technical schemes to deviate from the spirit and scope of the technical schemes of the various embodiments of the present invention.

The invention claimed is:

1. An LED lamp structure, comprises:

light-emitting components, driver power supply and electrical connection components;

said light-emitting components include an LED lamp pole; thick wires are installed below said LED lamp pole and said thick wires are electrically connected to said LED lamp pole;

the driver power supply includes a driver circuit board and said driver circuit board is connected to a female connector for plugging to said thick wires, so that said thick wires are electrically connected to said driver power supply through said female connector;

said female connector is of a hollow structure and at least one end is an end with a funnel-shaped opening; and a contact pin is installed between said female connector and said driver circuit board; said funnel-shaped opening end of said female connector is joined to one end of said contact pin and the other end of said contact pin is welded to said driver circuit board.

2. The LED lamp structure stated in claim 1, further comprises an insulation sleeve and said driver power supply is installed inside the hollow structure of said insulation sleeve.

3. The LED lamp structure stated in claim 1, wherein said funnel-shaped opening end of said female connector is connected to said thick wires.

4. The LED lamp structure stated in claim 1, wherein both ends of said female connector have a funnel-shaped opening structure and they are respectively joined to the non-welded end of said contact pin and said driver circuit board, as well as the non-connected end of said thick wires and said LED lamp pole.

5. The LED lamp structure stated in claim 1, wherein said LED lamp pole includes a stem and LED light source; the inside of said stem is of a hollow structure; said thick wires are positioned in said hollow structure, they do not extend beyond the position of the bell mouth of the stem and they are electrically connected to said LED light source.

6. The LED lamp structure stated in claim 2, wherein said driver circuit board is welded to an edge wire; said edge wire is of a bendable structure; when said driver power supply is installed inside the hollow structure of said insulation sleeve, said edge wire bends and extends out of the outer wall of said insulation sleeve.

7. The LED lamp structure stated in claim 2, wherein said driver circuit board is horizontally or vertically installed inside the hollow structure of said insulation sleeve.

8. The LED lamp structure stated in claim 4, wherein a cut-off point is installed in the middle of said female connector and one end of said female connector extends into the bell mouth of said stem.

9. The LED lamp structure stated in claim 5, wherein a cross-sectional surface in said stem is a han character radical 46 shape depicted as "凵"; the concave part of the shape is said hollow structure and the peak of the shape is a exhaust pipe, which is used in filling inert gases for heat dissipation into the bulb shell of the LED lamps.

10. An LED lamp structure, comprises:

a light-emitting components, a driver power supply and an electrical connection components;

an LED lamp pole of said light-emitting components includes a stem and an LED light source; top thick wires are installed on top of said stem and bottom thick wires are installed below said stem; at least one of said top thick wires is electrically connected to said LED light source through a female connector;

the driver power supply includes a driver circuit board; a contact pin of said driver circuit board is electrically connected to said bottom thick wires;

said driver circuit board is connected to the female connector for plugging to said thick wires, so that said thick wires are electrically connected to said driver power supply through said female connector;

said female connector is of a hollow structure and at least one end is an end with a funnel-shaped opening; and a contact pin is installed between said female connector and said driver circuit board; said funnel-shaped opening end of said female connector is joined to one end of said contact pin and the other end of said contact pin is welded to said driver circuit board.

11. The LED lamp structure stated in claim 10, wherein said top thick wires are further fastened to said female connector through pressing, bending or welding.

12. A preparation process of an LED lamp structure, comprises:

Step 1: weld a stem with thick wires to a light source;

Step 2: fuse and seal the bell mouth of the stem and the opening end of a bulb shell;

Step 3: fill the bulb shell with heat-dissipating inert gases from an exhaust pipe and seal the exhaust pipe;

Step 4: place an insulation sleeve outside of a driver power supply, wind an edge wire around an insulation sleeve and extend it upwards out of the insulation sleeve;

Step 5: install the driver power supply in a lamp holder, extend an electrode wire on a driver circuit board out from a hole of the lamp holder and the edge wire is pressed between the insulation sleeve and the lamp holder;

Step 6: welding of mud into the lamp holder and fasten the driver power supply in the lamp holder;

Step 7: assemble the lamp holder, plug the thick wires to a female connector, extend one end of the female connector into the bell mouth of the stem and the thick wires shall not extend beyond the bell mouth of the stem or the length extending beyond the bell mouth of the stem shall not exceed 5 mm; weld the other end of the female connector onto the driver power supply; at the same time, install the lamp holder onto a sealing position of the bulb shell and fasten and connect by welding with mud; and Step 8: fasten a rivet onto the hole of the lamp holder; at the same time, electrically connect it with said electrode wire of the driver power supply.

13. The preparation process of claim 12, wherein step 7 further comprises:

installing a cut-off point in a middle of the female connector, wherein the female connector is a double-head female connector;

plugging one end of the female connector to the thick wires when two contact pins are installed on the driver power supply and while assembling the lamp holder, plugging one end of the female connector to the thick wires;

then plugging the contact pin to the other end of the female connector, or plugging the female connector to the contact pin first before the thick wires are plugged to the other end of the female connector;

wherein the thick wires and contact pin do not extend beyond the cut-off point of the female connector and said thick wires do not extend beyond the position of the bell mouth of the stem; and extending at the same time one end of the female connector into the bell mouth of the stem and the other end out of the bell mouth of the stem.

14. A preparation process of an LED lamp structure, comprises:

Step 1: weld the light source onto a stem with thick wires and that is welded with a female connector on the thick wires; said female connector is entirely positioned inside of a bell mouth of the stem;

Step 2: fuse and seal the bell mouth of the stem and the opening end of a bulb shell;

Step 3: fill the bulb shell with heat-dissipating inert gases from an exhaust pipe and seal the exhaust pipe;

Step 4: place an insulation sleeve outside of a driver power supply, wind an edge wire around the insulation sleeve and extend it upwards out of the insulation sleeve;

Step 5: install the driver power supply in a lamp holder, extend one electrode wire of the driver power supply outside of a hole of the lamp holder and the edge wire is pressed between the insulation sleeve and lamp holder;

Step 6: welding of mud into the lamp holder and fasten the driver power supply in the lamp holder;

Step 7: assemble the lamp holder, position both ends of the female connector into the bell mouth of the stem, plug a contact pin on the driver power supply to the female connector and the thick wires shall not extend out of the bell mouth of the stem; at the same time, install the lamp holder onto a sealing position of the bulb shell and fasten and connect them by welding with mud; and Step 8: fasten a rivet onto the hole of the lamp holder and at the same time, electrically connect it with said electrode wire of the driver power supply.

* * * * *